United States Patent [19]

Markham

[11] Patent Number: 4,768,317

[45] Date of Patent: Sep. 6, 1988

[54] ULTRA-LITE STATIONARY AWNING STRUCTURES

[76] Inventor: Gaynor P. Markham, 1184 Alden Rd., Orlando, Fla. 32803

[21] Appl. No.: 794,561

[22] Filed: Nov. 4, 1985

[51] Int. Cl.[4] ..... E04B 1/34

[52] U.S. Cl. ..... 52/74; 52/DIG. 13; 52/63; 52/741; 160/389; 135/117; 135/119

[58] Field of Search ..... 52/74–78, 52/DIG. 13, 73, 63, 90, 80, 82, 200, 222, 102, 741; 160/83 R, 387–389, 76, 123, 45, 385, 56, 57, 404; 135/89, 90, 101, 115, 117, 119, DIG. 5, DIG. 8; 248/345; 312/100–102; 24/306

[56] References Cited

U.S. PATENT DOCUMENTS

| | | | |
|---|---|---|---|
| 462,324 | 11/1891 | Newton | 160/53 |
| 1,087,490 | 2/1914 | Henry | 52/74 X |
| 1,646,910 | 10/1927 | Greenspoon | 160/81 |
| 1,932,945 | 10/1933 | Wilson | 160/382 X |
| 2,423,402 | 7/1947 | Olsen | 135/119 X |
| 2,503,136 | 4/1950 | Simpson | 160/83 R |
| 2,565,545 | 8/1951 | Card | 160/83 R |
| 2,583,663 | 1/1952 | Oberchain | 160/76 |
| 2,714,233 | 8/1955 | Martin | 52/77 |
| 2,805,711 | 9/1957 | Mehl | 160/76 |
| 2,883,712 | 4/1959 | Shelamer, Sr. | 52/63 |
| 3,075,257 | 1/1963 | Rosen | 52/75 X |
| 3,100,012 | 8/1963 | Dunn | 52/74 X |
| 3,123,868 | 3/1964 | Gust | 52/107 X |
| 3,911,633 | 10/1975 | Bamberger | 52/75 |
| 4,094,021 | 6/1978 | Rapp | 24/306 X |
| 4,102,307 | 7/1978 | Cusick et al. | 52/222 X |
| 4,665,671 | 5/1987 | Sarvis | 52/74 X |

FOREIGN PATENT DOCUMENTS

| | | | |
|---|---|---|---|
| 2263375 | 7/1974 | Fed. Rep. of Germany | 52/222 |

*Primary Examiner*—Carl D. Friedman

*Attorney, Agent, or Firm*—Duckworth, Allen, Dyer & Doppelt

[57] ABSTRACT

An awning structure having two vertical support members, one attached to each end of a horizontal bar; two horizontal projection bars, one attached to the bottom end of each of the supports; two rafter bars each attached to one of the projection bars and the header bar; and a front bar which is attached to the rafter bars. A fabric cover is removably attached to the header bar by a rope track extruding from the header bar. The fabric cover is removably attached to the front bar and projection bars by a plurality of velcro strips.

9 Claims, 3 Drawing Sheets

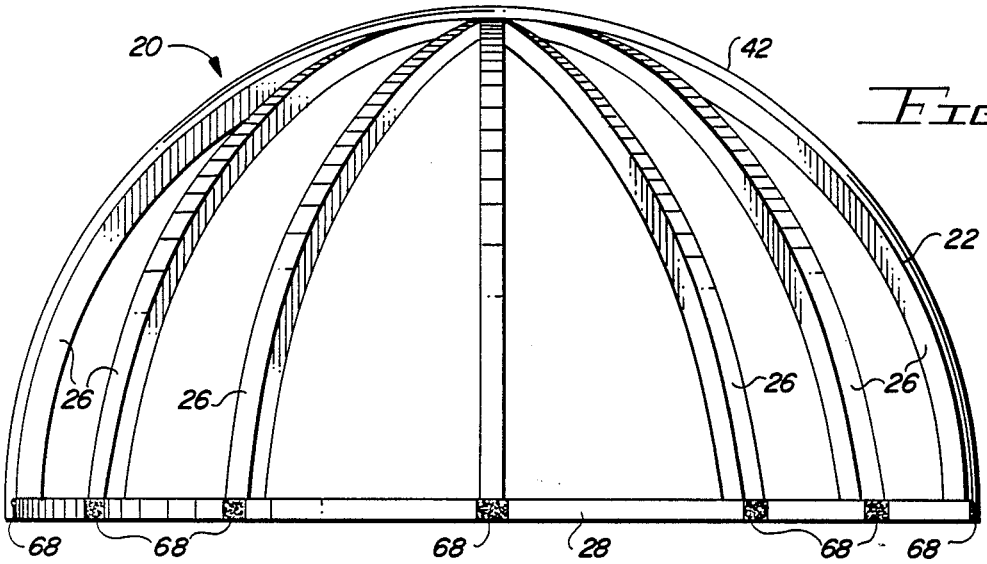
FIG. 8
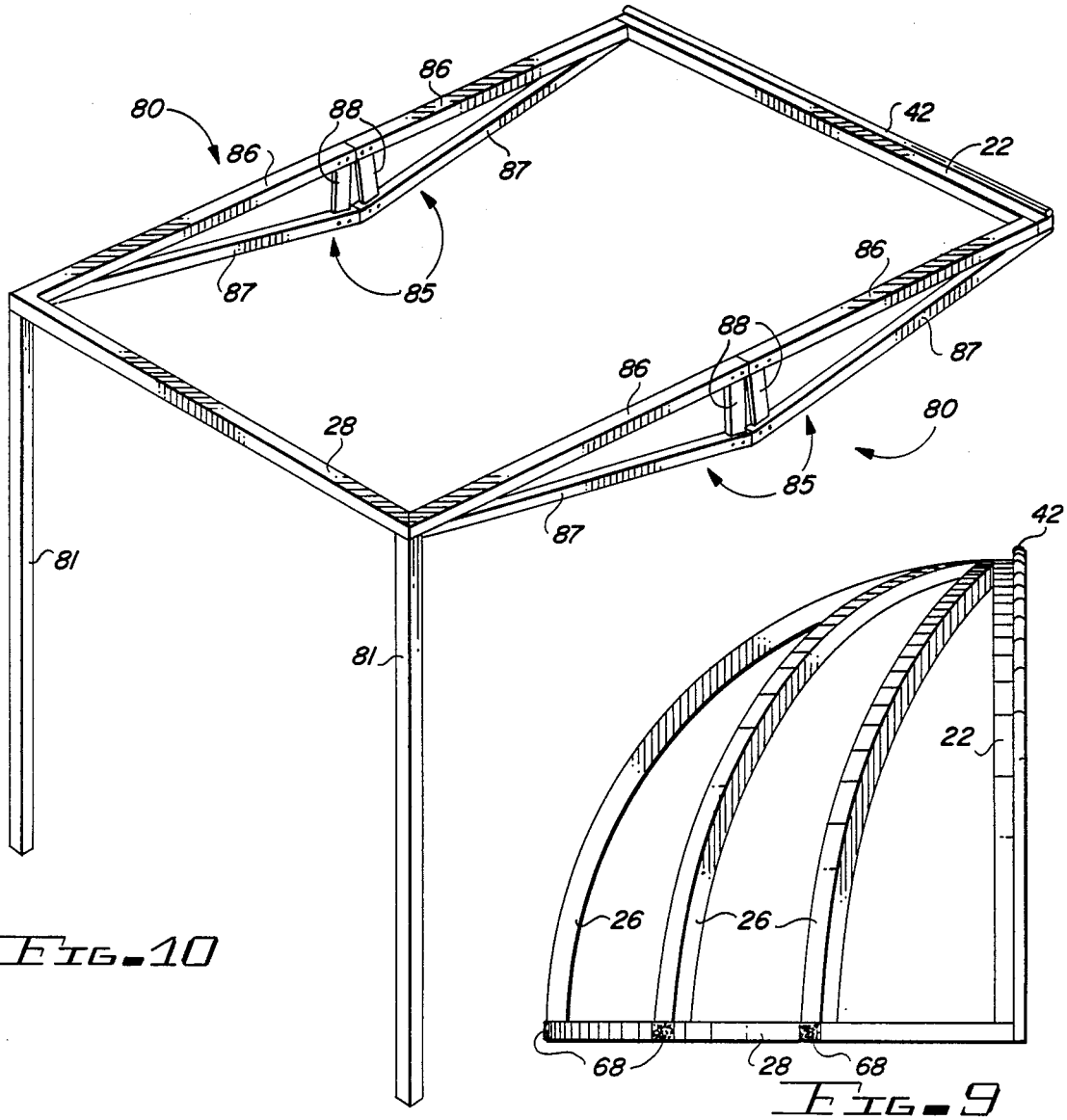
FIG. 10
FIG. 9

ULTRA-LITE STATIONARY AWNING STRUCTURES

BACKGROUND OF THE INVENTION

This invention relates generally to the field of stationary awnings and, more particularly, to lightweight awning structures having flexible coverings.

Awnings are frequently used as roof-like covers extending over a window or doorway. Such awnings typically include a frame structure with a fabric or vinyl covering. Under present building practice, the installation and removal of an awning cover from the awning frame is very time consuming. In one type of awning structure the frame comprises a front bar constrained by two projection bars which are connected to a building with eye ends that pivot on hinges. The top edge of a fabric cover is generally attached to the building above the projection bars and the front bar fits through a hem in the front edge of the fabric cover. The weight of the front bar holds the fabric cover taut and the fabric cover restrains the front bar and projection bars from pivoting downward. Since the fabric cover must be held taut even in windy weather, the front bar is usually heavy. A disadvantage of this type of awning structure is that the attachment of these frame members requires special pipe fittings such as eye ends, pipe clamps, and hinges.

Another disadvantage of this type of structure is that the fabric cover cannot be removed unless the frame is disassembled. The front bar must be fed through the hem in the fabric cover before the front bar is attached to a projection bar. Thus, the fabric cover must be attached to the frame before the frame is fully assembled. If a need to remove the fabric cover arises, the front bar must be disconnected from the projection bar so the cover can slide off the front bar. Since the awning frame must be partially disassembled to remove the fabric cover, the fabric cover cannot be removed quickly and easily.

A second type of awning structure has a welded frame. The hems of the fabric cover used in this type are called lacing pockets or lacing strips which generally have brass grommets allowing the fabric to be laced to the frame with a cord or rope. In this type of structure, lacing the fabric cover to the frame takes a considerable amount of time since many grommets must be used to hold the fabric cover taut. Due to stresses on the fabric cover along with climatic changes, the fabric cover expands, and becomes less taut with age. Since the fabric cover is constrained by the specific grommets, the user must relace or in some cases replace the fabric cover if a greater tension is desired. Additionally, removal of the fabric cover is time consuming since the entire cover must be unlaced or the ropes cut before the cover can be removed.

Seams in the fabric covers of the prior art are typically stitched with thread. Rain water saturates the thread causing the thread to rot and therefore deteriorate before the fabric cover itself. When the thread deteriorates, the fabric cover cannot be constrained by the awning frame. Therefore, the stitching of the awning cover tends to shorten the awning's life.

Since an awning structure is generally attached to the outside of a building, it is subject to the forces of the elements. Awning structures are especially vulnerable to large storms and hurricanes. The storm winds frequently exert stresses on the awning structure greater than the awning structure can withstand. As a result, both the awning structure and the building to which the structure is attached are often severely damaged. Damage to the awning structure caused by a large storm or hurricane can generally be avoided if the awning cover is removed prior to the storm. Since the awning cover comprises the vast majority of the surface area of the awning structure, its removal drastically reduces the force which the storm exerts. Because of the difficulty and the time required to remove the fabric covers of the awning structures currently in use, storms often arise before the covers can be removed. Therefore, an awning structure in which the awning cover can be removed quickly and easily is highly desirable.

It is an object of the present invention to provide an improved awning structure.

It is a further object of the present invention to provide an awning structure in which the fabric cover of the structure can easily be removed from the awning frame.

It is a further object of the present invention to provide an awning structure in which the frame need not be disassembled before the fabric cover can be removed.

It is still a further object of the present invention to provide an awning structure in which the fabric cover is attached only to the awning frame.

It is still a further object of the present invention to provide an awning structure in which the tension of the awning cover can be increased if the cover expands.

SUMMARY OF THE INVENTION

The improved awning structure of the present invention, is characterized by a fabric covering which can easily be attached to the awning frame and easily removed. The awning frame includes two vertical support members, one attached to each end of a horizontal header bar; two horizontal projection bars, one attached to the bottom end of each of the vertical supports; two rafter bars each attached to the header bar and one of the projection bars; and a front bar which is attached to the projection and rafter bars. The fabric cover has a track rope affixed to a hem at its top edge. The header bar has a track protruding from its top face to receive the track rope thus constraining the top end of the fabric cover. The fabric cover is attached to the front bar and projection bars by a plurality of Velcro strips affixed to the fabric cover which mate with Velcro strips on the front bar and projection bars.

Use of Velcro strips to attach the fabric cover to the awning frame allows rapid and easy removal of the fabric cover since the Velcro strips need only be pulled apart before the cover can be removed. Additionally, the use of Velcro strips allows the tension in the fabric cover to be increased if the cover expands. Additionally, if the fabric cover expands the tension in the fabric cover can be increased by merely pulling the Velcro strips on the fabric cover away from the Velcro strips on the frame, tugging on the fabric cover to increase its tension, and then reattaching the Velcro strips on the fabric cover with the Velcro strips on the frame.

The awning frame is preferably made of lightweight aluminum tubing rather than heavier steel pipe so as to reduce the stresses the frame exerts on the wall of the building structure to which it is attached. Additionally, since an aluminum frame is relatively light, it can be assembled at the factory, easily transported to the user's site, and easily attached to a building.

BRIEF DESCRIPTION OF THE DRAWINGS

The foregoing and other objects, features and advantages will become more apparent by reference to the following detailed description, taken in conjunction with the accompanying drawing in which:

FIG. 8 is a front plan view of a curved awning frame;

FIG. 9 is a side plan view of the awning illustrated in FIG. 8; and

FIG. 10 is a perspective view of an awning frame with truss members;

DESCRIPTION OF THE PREFERRED EMBODIMENT

Figure 1:
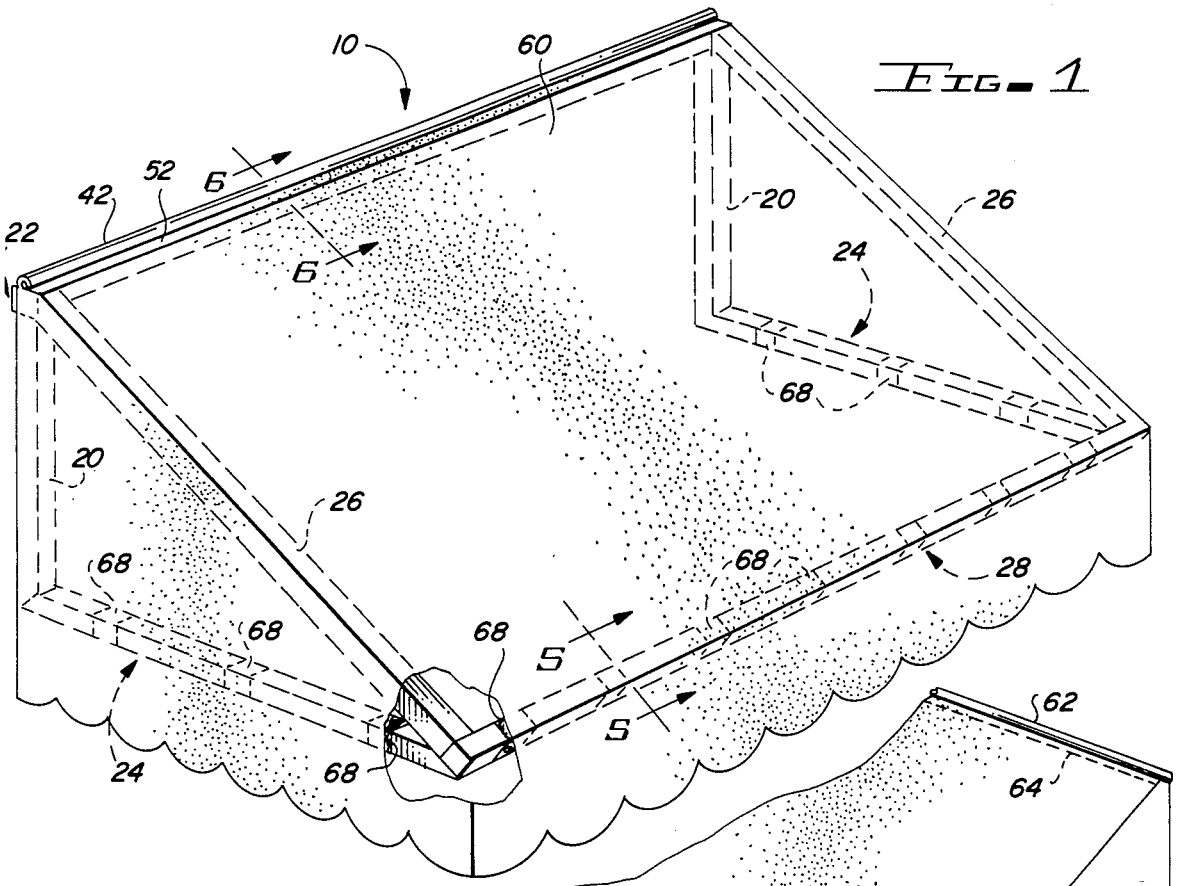
FIG. 1 is a perspective view of an awning structure in accordance with the present invention.
Figure 3:
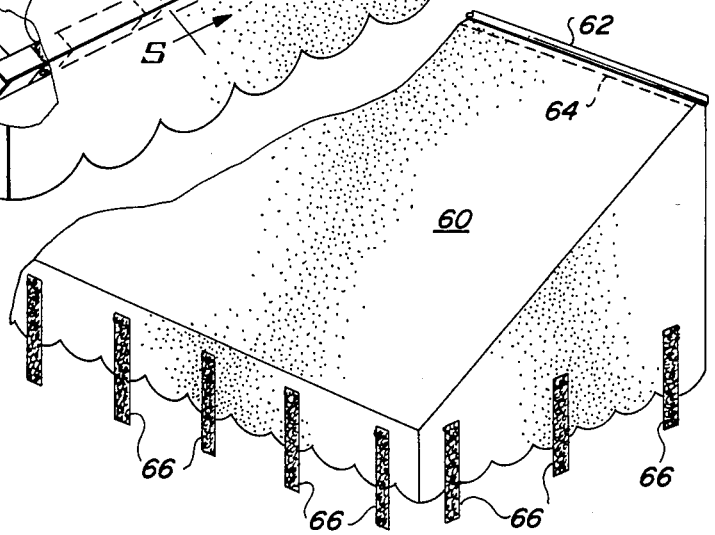
FIG. 3 is a perspective view of the underside of a fabric cover illustrating Velcro strips attached to a fabric cover in accordance with the present invention.

Referring first to FIG. 1, the preferred embodiment of the present invention is shown in the form of an awning structure 10. The awning structure 10 has two basic components; an awning frame 15 and a fabric cover 60 which fits over the frame 15.

Figure 4:
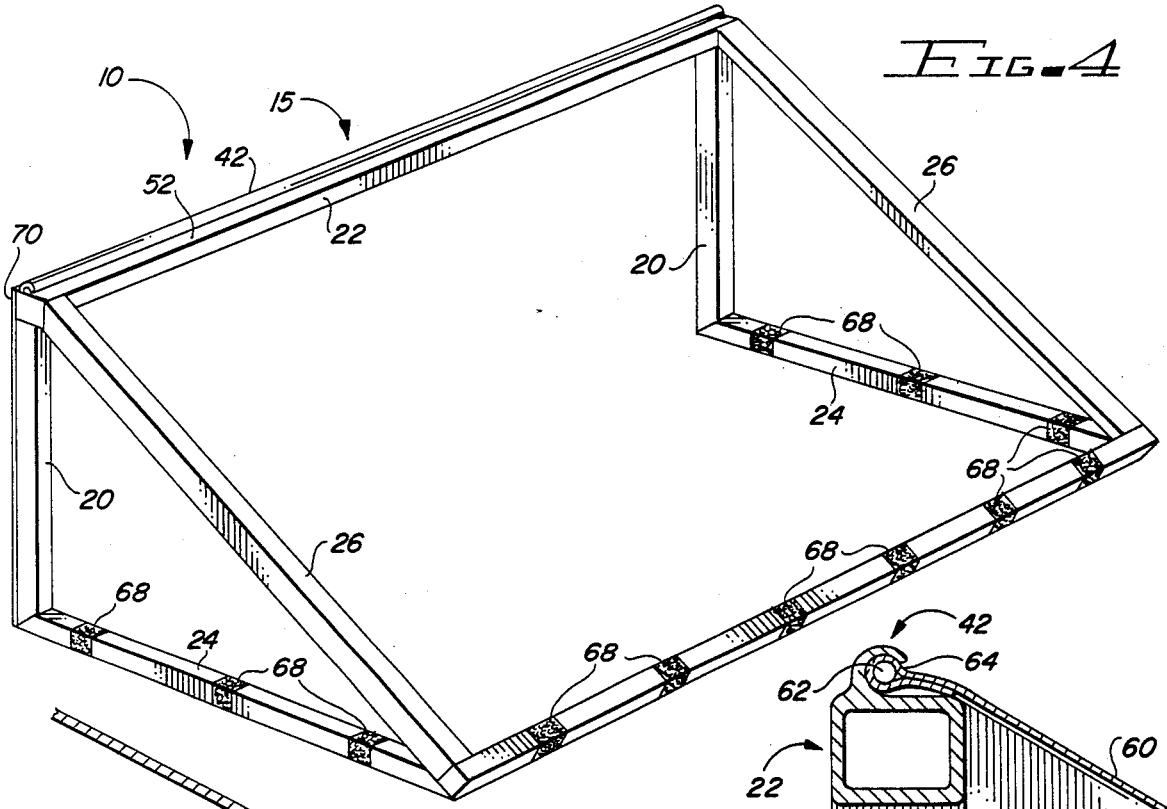
FIG. 4 is a perspective view of an awning frame in accordance with the present invention.

Referring now to FIGS. 1 and 4, it is shown that the awning frame 15 has two vertical support members 20, two horizontal projection bars 24, two rafter bars 26, a horizontal header bar 22 and a horizontal front bar 28. The two vertical support members 20 and the header bar 22 are adapted for attachment to a wall of a building structure (not shown) for supporting the awning structure. Each end of the horizontal header bar 22 abuts the top end of one of the two vertical support members 20. The bottom end of each vertical support member 20 abuts a horizontal projection bar 24 with each horizontal projection bar 24 protruding orthogonal to the plane containing the header bar 22 and the vertical support members 20. Each end of the horizontal front bar 28 abuts the protruded end of one of the projection bars 24 such that the front bar 28 is parallel to the header bar 22. One end of each rafter bar 26 abuts an end of the header bar 22 while the opposite end of each rafter bar 26 abuts the junction of the projection bar 24 and the front bar 28 so that the rafter bars 26 are parallel. Thus, the members of the awning frame 15 form two equal and parallel right triangles separated by the header bar 22 and the front bar 28, with each triangle having one vertical support member 20 and one horizontal projection bar 24 as its two legs, as well as one rafter bar 26 as its hypotenuse. In a preferred embodiment all abuttments are welded to ensure structural integrity. Preferably, the entire frame 15 is constructed of square aluminum tubing.

Referring again to FIG. 1 there is illustrated the flexible cover 60, which may be, for example, a fabric or vinyl cover, held taut by the awning frame 15. The fabric cover 60 is attached to the awning frame 15 at the front bar 28, the header bar 22 and each of the projection bars 24.

Figure 6:
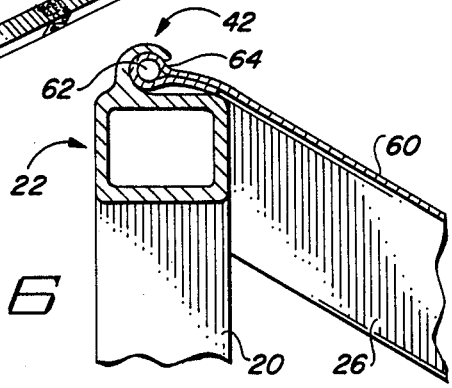
FIG. 6 is a section view VI—VI of FIG. 1 illustrating a track rope constrained by a track on a header bar.

FIG. 6 illustrates how the fabric cover 60 is attached to the header bar. The header bar 22 is square tubing with a protruding rope track 42 on its top face. The cross-section of the track 42 is in the form of a C-shape with its open portion toward the rafter bars 26. A hem 64 at the top portion of the fabric cover 60 is expanded by a rope 62 attached within the hem 64 by electronically welding the rope 62 to the hem 64 using RF (radio frequency) energy but can also be attached by heat sealing or stitching the rope 62 to the hem 64. The expanded hem 64 is received through one of the ends of the track 42 and is slid along the track 42 until the entire rope 62 is within the track. Although the rope 62 may move longitudinally along the track 42, movement of the rope 62 in any other direction is constrained by the track 42. Thus the fabric cover 60 is removably attached to the header bar 22.

Referring again to FIG. 1, it is shown that attachment of the awning cover 60 to the front bar 28 and projection bars is accomplished with the use of Velcro hook strips 66 attached to the underside of the fabric cover 60.

Figure 7:
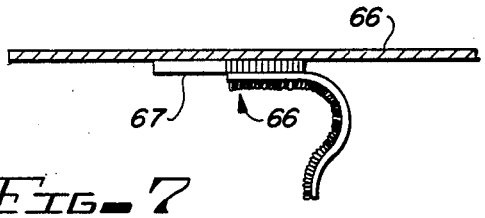
FIG. 7 is a plan view of a Velcro strip attached to the awning cover.

FIG. 7 illustrates how the Velcro hook strips 66 are attached to the awning cover 60. The Velcro hook strip 66 is sewn to a vinyl strip 67 which is heat sealed or electronically welded to the awning cover 60. Since the thread which attaches the Velcro hook strip 66 to the vinyl strip 67 never penetrates the awning cover, it is never subject to rainwater and therefore not likely to deteriorate quickly. In a preferred embodiment the Velcro hook strips 66 are attached twelve inches apart.

Figure 5:
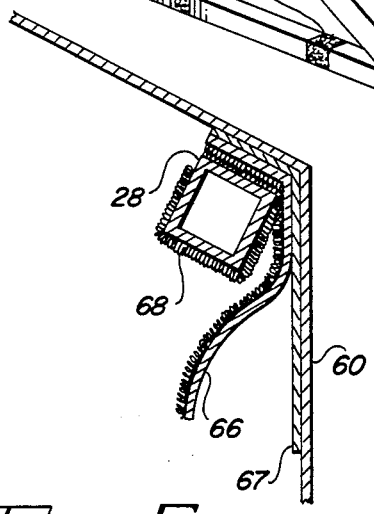
FIG. 5 is a section view V—V of FIG. 1 illustrating a fabric cover attached to a front bar.

FIG. 4 shows a plurality of Velcro loop strips 68 adhesively attached to the front bar 28 and projection bar 24. In FIG. 5, it can be seen that the loop strips 68 are attached complimentary to the hook strips 66 so that the hook strips 66 mate with the loop stripes 68 when the awning cover 60 is placed on the frame 15. Thus, the awning cover 60 is removably attached to the front bar 28 and projection bars 24 by the use of Velcro strips.

Removal of the fabric cover 60 from the awning frame 15 is easily accomplished. First, the Velcro hook strips 66 are separated from the Velcro loop strips 68, then the fabric cover is slid out the end of the track 42.

Figure 2:
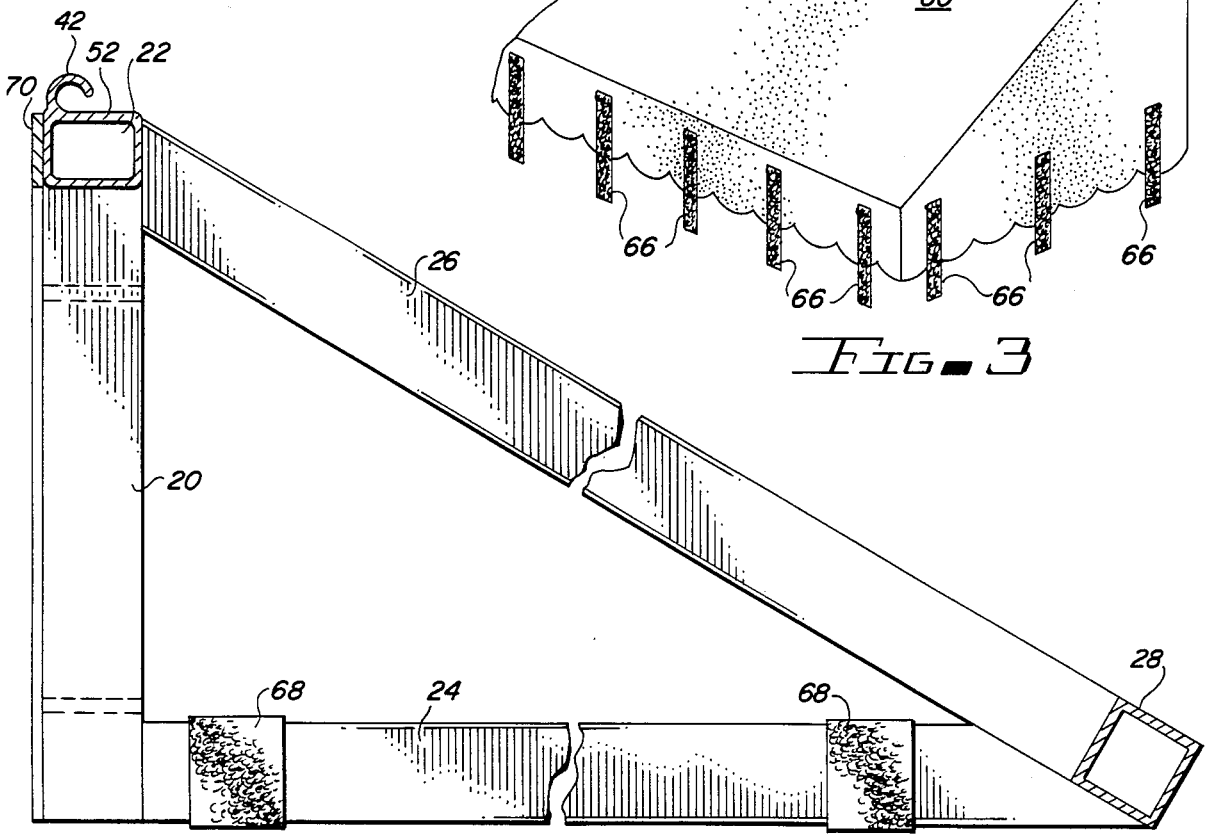
FIG. 2 is a plan view of the side of the inventive awning frame.

Referring now to FIG. 2, it is seen that closed cell foam rubber 70 is attached to the back face of the header bar 22 and the two vertical support members 20. When the awning frame is attached to a building, the closed cell foam rubber 70 acts as a water-proof seal to prevent water from passing between the awning structure and the building.

Another embodiment of the present invention is illustrated in FIGS. 8 and 9. Here, a curved awning frame 20 is shown having a semi-circular arc shaped header bar 22, a semi-circular arc shaped front bar 28, and a plurality of quarter circular arc shaped rafter bars 26. The header bar 22 is adapted for attachment to a wall of a building structure (not shown) for supporting the awning structure. Each end of the front bar 28 abuts an end of the header bar 22 such that the plane containing the front bar 28 is normal to the plane containing the header bar 22. One end of each of the rafter bars 26 abuts the center of the header bar 22 and the opposite end of each of the rafter bars abuts the front bar such that each plane containing a rafter bar 26 is normal to the plane containing the front bar 28.

Another embodiment of the present invention is illustrated in FIG. 10. Here, the awning frame 15 has two vertical support members 81, two truss assemblies 80, a horizontal header bar 22, and a horizontal front bar 28. The header bar 22 is adapted for attachment to a wall of a building structure (not shown) for supporting the awning frame 15. Each end of the horizontal header bar 22 abuts an end of one of the two truss assemblies 80. The other end of each truss assembly 80 abuts one of the ends of the front bar 28. The top end of each vertical support 81 abuts an end of the front bar 28 with the bottom end of each vertical support adapted for attachment to the ground or a floor of a building (not shown). Thus, the two truss assemblies 80, the header bar 22 and the front bar 28 form a rectangle with the header bar 22 and the front bar 28 parallel to each other, and the two truss assemblies 80 parallel to each other.

Each truss assembly 80 consists of two three-membered simple trusses 85, with each simple truss 85 having a top bar 86, a bottom bar 87, and a stringer bar 88 attached together to form a triangle. The two simple trusses 85 are attached together with the stringer bars 88 facing each other and with the top bars 86 mutually parallel to each other so that the two top bars form one long continuous member, with the plane containing the truss assembly 80 normal to the ground or floor.

Preferably, the three members in each simple truss 85 are welded together and each end of truss assembly 80 is welded either to the header bar 22 or to the front bar 28. Additionally, the simple trusses 85 are removably attached to each other and the vertical supports 81 are removably attached to the rest of the frame.

Figure 11:
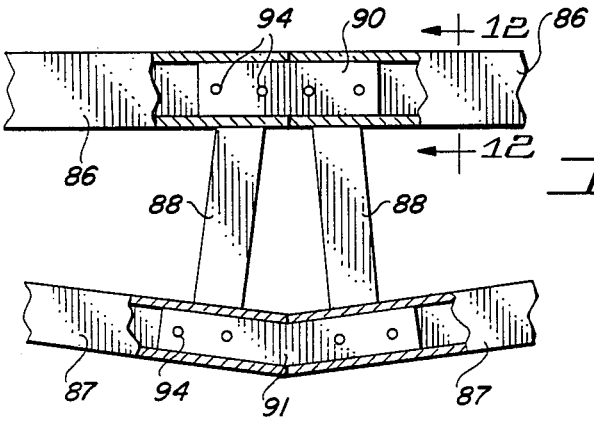
FIG. 11 is a partial side view of the truss attachment.
Figure 12:
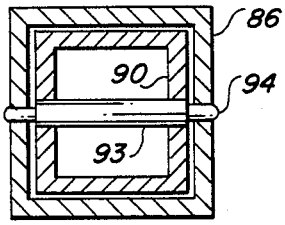
FIG. 12 is a section view XII—XII of FIG. 11 illustrating a spring pin assembly.

Reference is now made to FIGS. 11 and 12 which shows the attachment of the simple trusses 85. In a preferred embodiment, the top bars 86 and the bottom bars 87 are made of square aluminum tubing. A straight splicing member 90, made of square aluminum tubing in which the outside perimeter is slightly smaller than the inside perimeter of the top bar 86, is inserted into adjacent ends of two top bars so that the splicing member 90 is contained within the adjacent top bars 86. Reference is made to FIG. 12 where it is shown that a plurality of springpins 93, available from Medalist Industries under the name of Expanpin, is attached through the splicing member 90 so that the compressible ends of each springpin 93 protrudes normal from opposite faces of a splicing member 90. Aligned apertures 94 are provided through the top bars 86 for receiving the compressible ends of the springpins 93 when the spring pin 93 is inserted into the top bar 86. Thus, adjacent top bars are easily attached by the splicing members 90 and the spring pins 93.

Attachment of the bottom bars 87 is similar to that of the top bars 86. Here, however, the adjacent bottom bars 87 do not form a straight line but rather an obtuse angle. Therefore, an angled splicing member 91 is inserted through adjacent bottom bars 87 in which the angle formed by the splicing member 91 is equal to the angle formed by the adjacent bottom bars 87. Additionally, a plurality of spring pins 93 are provided through the angled splicing members and received by aligned apertures 94 through the bottom bar so that no relative motion between the bottom bars 87 is permitted. Thus, two simple trusses 85 are attached by the splicing members to form a truss assembly 80.

Figure 13:
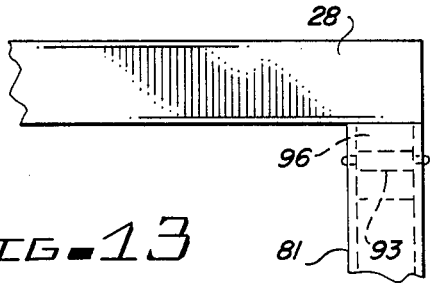
FIG. 13 is a partial front view of a vertical support attached to a front bar.

FIG. 13 shows the attachment of the vertical supports 81 to the front bar 28. Here, a vertical splicing member 96, made of square aluminum tubing the outside perimeter of which is slightly smaller than the inside perimeter of the vertical support 81, is welded onto the end of the front bar 28 and inserted into the top end of the vertical support 81. A plurality of springpins 93 are provided through the vertical splicing member 96 and received by aligned apertures 94 within the vertical supports 81 to restrain motion of the vertical supports 81 relative to the front bar 28.

While the principals of the invention have now been made clear in an illustrative embodiment, there will become obvious to those skilled in the art many modifications in structure, arrangement, portions, materials and components used in the practice of the invention and otherwise which are particularly adapted for specific environments and operating requirements without departing from those principals. The appended claims are therefore intended to cover and embrace any such modifications, within the limits only of the true spirit and scope of the invention.

I claim:

1. An awning structure comprising:

(a) a horizontal header bar adapted for attachment to a wall, said header bar comprising a rectangular extrusion having a substantially planar surface for positioning facing the wall and a C-shaped track extending along an upper surface of said bar having an opening facing away from the wall;

(b) two vertical supports, adapted for attachment to a wall, each having a top end welded, respectively, to opposite ends of said header bar;

(c) two horizontal projection bars protruding normal to the plane formed by said vertical supports and said header bar wherein each projection bar is welded to a lower end of a corresponding one of said vertical supports;

(d) a horizontal front bar having first and second ends welded to corresponding protruding ends of said projection bars;

(e) two rafter bars, each having one end welded to a corresponding end of said header bar and a second end welded to said front bar;

(f) a fabric cover having one edge hemmed to form a loop for receiving a rope having a diameter larger than the opening in the C-shaped track;

(g) means for removably attaching said fabric cover to said header bar by sliding the hemmed edge with the rod inserted into the C-shaped track; and (h) means for removably attaching said cover to said front bar and said projection bars, said attaching means being adjustable to compensate for stretching and shrinking of said cover.

2. An awning structure, according to claim 1 wherein said means for removably attaching said cover to said front bar and said header bar comprises:

(a) a plurality of Velcro hook stripes having ends which are electronically welded at intervals along the front and side edges of said fabric cover; and (b) a plurality of Velcro loop strips attached to said front bar and projection bars for receiving said Velcro hook strips.

3. An awning structure according to claim 1 wherein said bars and supports are constructed of lightweight square tubing.

4. An awning structure according to claim 3 wherein the top face of each said front bar is flush with the top face of said rafter bar.

5. A method for removably attaching a flexible awning cover to an awning frame, comprising the steps of:

(a) providing an awning frame which has a horizontal header bar, two vertical supports the tops of which are connected to opposite ends of the header bar, two horizontal projection bars protruding normal to a plane formed by the vertical supports and the header bar with each projection bar being connected to a lower end of one of the vertical supports, a horizontal front bar having ends which are connected to protruding ends of the projection bars, and two rafter bars connected to opposite ends of the header bar and the front bar;

(b) forming an extruded C-shaped track on the header bar;

(c) attaching a plurality of first Velcro strips along the front bar and projection bars;

(d) providing an awning cover including a top edge, a bottom edge and two side edges;

(e) providing a hem in the top edge of the cover;

(f) expanding the hem;

(g) attaching a second plurality of Velcro strips adapted for mating with the first strips at intervals along the front and side edges of the fabric cover;

(h) sliding the expanded hem which is in the top edge of the cover into the C-shaped track on the header bar;

(i) pulling the flexible cover taut; and (j) mating the first Velcro strips with the second Velcro strips.

6. An awning structure comprising:

an awning frame, including a header bar adapted for attachment to a wall of a building structure; a front bar; a plurality of rafter bars each having one end attached to the header bar and a second end attached to the front bar;

a flexible awning cover having an upper edge with a hem formed therein, and means in said hem for expanding said hem; and Velcro means for removably attaching said awning cover to said awning frame with Velcro fasteners so that said fasteners are sheltered from the elements by said awning cover;

an extruded track extending along an upper surface of said header bar and having an opening facing away from the wall dimensioned for slidably receiving said hem, the opening of said track being less than the expanded dimension of said hem whereby said hem is removably constrained within said track.

7. An awning structure according to claim 6 wherein said Velcro means further comprise:

(a) a plurality of first Velcro fasteners electronically welded near a bottom edge of said cover by RF energy; and (b) a plurality of second Velcro fasteners secured to said front bar and adapted for mating with said first Velcro fasteners.

8. An awning structure according to claim 6, wherein said header bar comprises a semi-circular arc header bar; said front bar comprises a semi-circular arc shaped front bar having two ends respectively attached to corresponding ends of said header bar such that the plane containing said front bar is normal to the plane containing said header bar; and said rafter bars are quarter-circular arc shaped rafter bars each having said one end attached to the center of the header bar so that said bars form a quarter-spherical shaped frame in which each plane containing a rafter bar is normal to the plane containing said front.

9. An awning structure according to claim 6, wherein said header bar comprises a horizontal header bar; wherein said rafter bars comprise two truss assemblies each having a first end connected to a corresponding end of said header bar and a second protruding end; wherein said front bar comprises a horizontal front bar having first and second ends each connected to a corresponding protruding end of said truss assemblies; and wherein said awning frame further comprises two depending vertical supports, each having a top end connected to a corresponding end of said horizontal front bar.

* * * * *